US007018237B2

(12) United States Patent
Zhan et al.

(10) Patent No.: US 7,018,237 B2
(45) Date of Patent: Mar. 28, 2006

(54) ELECTRICAL CONNECTOR WITH IMPROVED SHIELDING DEVICE

(75) Inventors: Hui Zhan, Kunsan (CN); Jinkui Hu, Kunsan (CN); Guohua Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/902,769

(22) Filed: Jul. 30, 2004

(65) Prior Publication Data

US 2005/0026501 A1 Feb. 3, 2005

(30) Foreign Application Priority Data

Jul. 30, 2003 (TW) ..... 92213900 U

(51) Int. Cl.
*H01R 13/648* (2006.01)

(52) U.S. Cl. ..... 439/607; 439/567

(58) Field of Classification Search ..... 439/607, 439/567, 608, 609, 79, 610
See application file for complete search history.

(56) References Cited

U.S. PATENT DOCUMENTS

| | | | | |
|---|---|---|---|---|
| 5,104,326 | A | 4/1992 | Smith et al. | |
| 6,165,015 | A * | 12/2000 | Wu et al. | 439/607 |
| 6,213,813 | B1 * | 4/2001 | Huang | 439/607 |
| 6,554,642 | B1 * | 4/2003 | Xiang et al. | 439/567 |
| 6,568,958 | B1 * | 5/2003 | Zhang et al. | 439/607 |

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical connector (100) includes an insulative housing (1), a number of contacts (3), a shielding device (40) and a pair of latch members (2). The shielding device includes a first and a second shielding portions (4, 5) assembled to the housing. The first shielding portion includes a body (41), a frame (42) extending forwardly from the body, and a number of elastic plates (44) extending rearwardly from an upper end of the body. Each elastic plate has an abutting portion (441). The second shielding portion has a top wall (51), a rear wall (52), and two side walls (53). The top wall defines a number of concaves (55) mating with the abutting portions of the elastic plates.

10 Claims, 4 Drawing Sheets

ELECTRICAL CONNECTOR WITH IMPROVED SHIELDING DEVICE

BACKGROUND OF THE INVENTION

1. Field of the Invention

The present invention relates to an electrical connector used in liquid crystal display (LCD), and particularly to an electrical connector which has an improved shielding device to prevent electromagnetic interference (EMI) and to achieve a good electrical performance.

2. Description of Related Art

With the development of electronics technology, a digital interface used in LCD was developed as a replacement for an analogous interface. Three interface standards, Plug and Display (P&D), Digital Flat Panel (DFP) and Digital Visual Interface (DVI) are concomitant and DVI will be the promising standard thereof. The DVI standard was developed by Digital Visual Working Group (DDWG) on April, 1999. U.S. Pat. No. 5,104,326 discloses such a connector comprising a connector housing having a front mating portion, a conductive shield having a shroud adapted to surround the front mating portion, and a tail aligner to position tail portions of terminals disposed in the connector housing. The conductive shield is secured to the front mating portion of the insulative housing to provide an EMI protection of the terminals. However, the shield only shields the front mating portion of the housing so that rear portions of the terminals are exposed outside of the housing and the shield. Due to the exposure of the rear portions of the terminals, the reliability of signal transmission of the terminals will be adversely affected. At the same time, contaminant such as dirt will be adhered to the rear portions of the terminals, which also adversely affects signal transmitting quality.

Hence, a connector with simple and improved shielding means is required to overcome the disadvantages of the prior art.

SUMMARY OF THE INVENTION

Accordingly, an object of the present invention is to provide an electrical connector having an improved shielding device to completely enclose a plurality of contacts thereof for achieving a better electrical performance.

In order to achieve the object set forth, an electrical connector in accordance with the present invention comprises an insulative housing, a plurality of contacts, and a shielding device.

The insulative housing comprises an elongate base having a top surface, a mounting surface opposite to the top surface, a front surface and a rear surface connecting with the top surface and the mounting surface, and a mating section extending forwardly from the front surface of the base and having a mating surface. The housing defines a plurality of receiving passageways therein. The contacts are received in the receiving passageways. The shielding device comprises a first and a second shielding portions. The first shielding portion includes a body abutting against the front face of the base, a frame extending forwardly from the body and surrounding the mating section, and a plurality of elastic plates extending rearwardly from the body. Each elastic plate has an abutting portion. The second shielding portion is assembled to a rear portion of the insulative housing and has a top wall, a rear wall, and two side walls. The top wall defines a plurality of concaves mating with the abutting portions of the elastic plates.

Other objects, advantages and novel features of the invention will become more apparent from the following detailed description when taken in conjunction with the accompanying drawings.

DETAILED DESCRIPTION OF THE INVENTION

Figure 1:
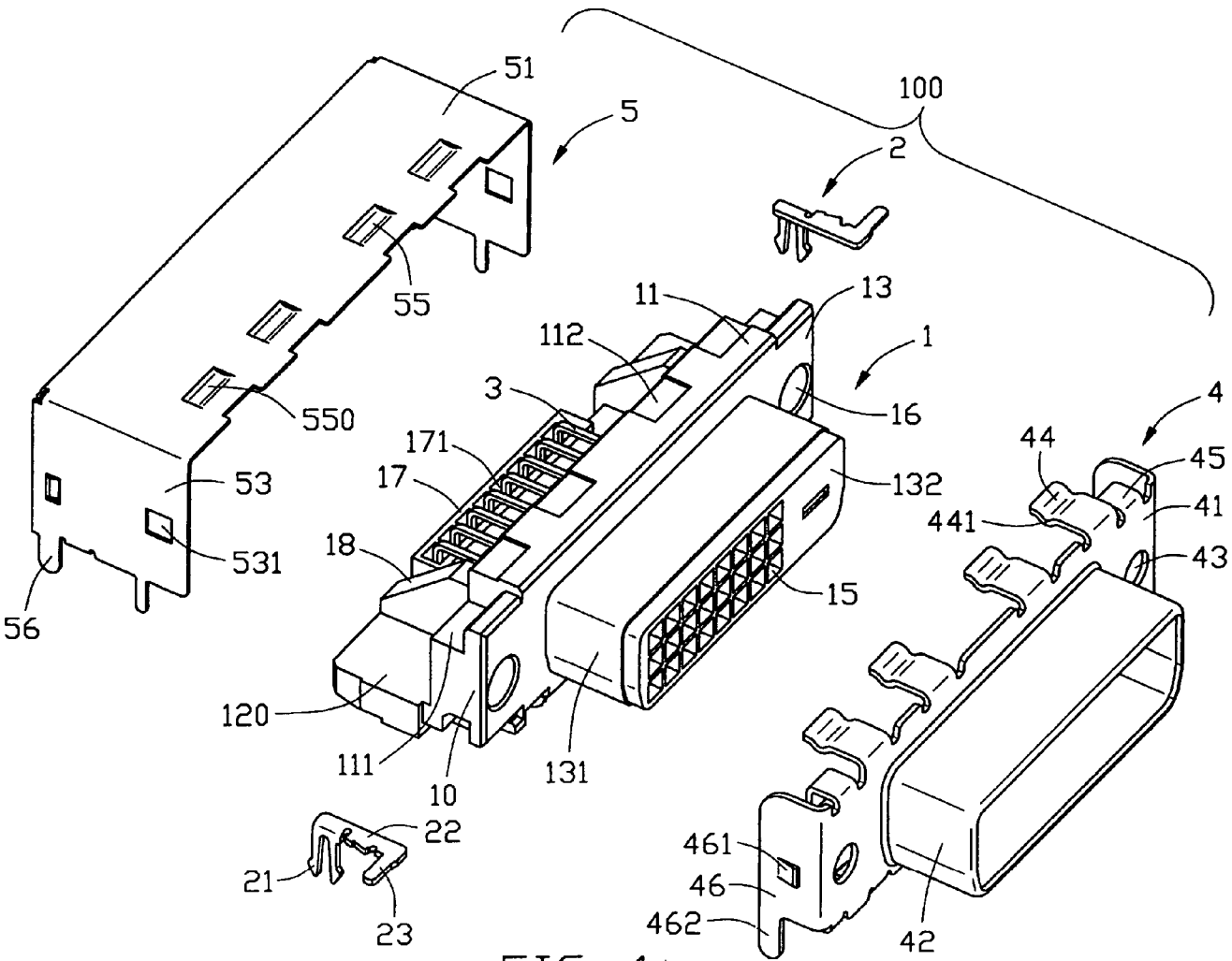
FIG. 1 is an exploded, perspective view of a connector in accordance with the present invention.
Figure 2:
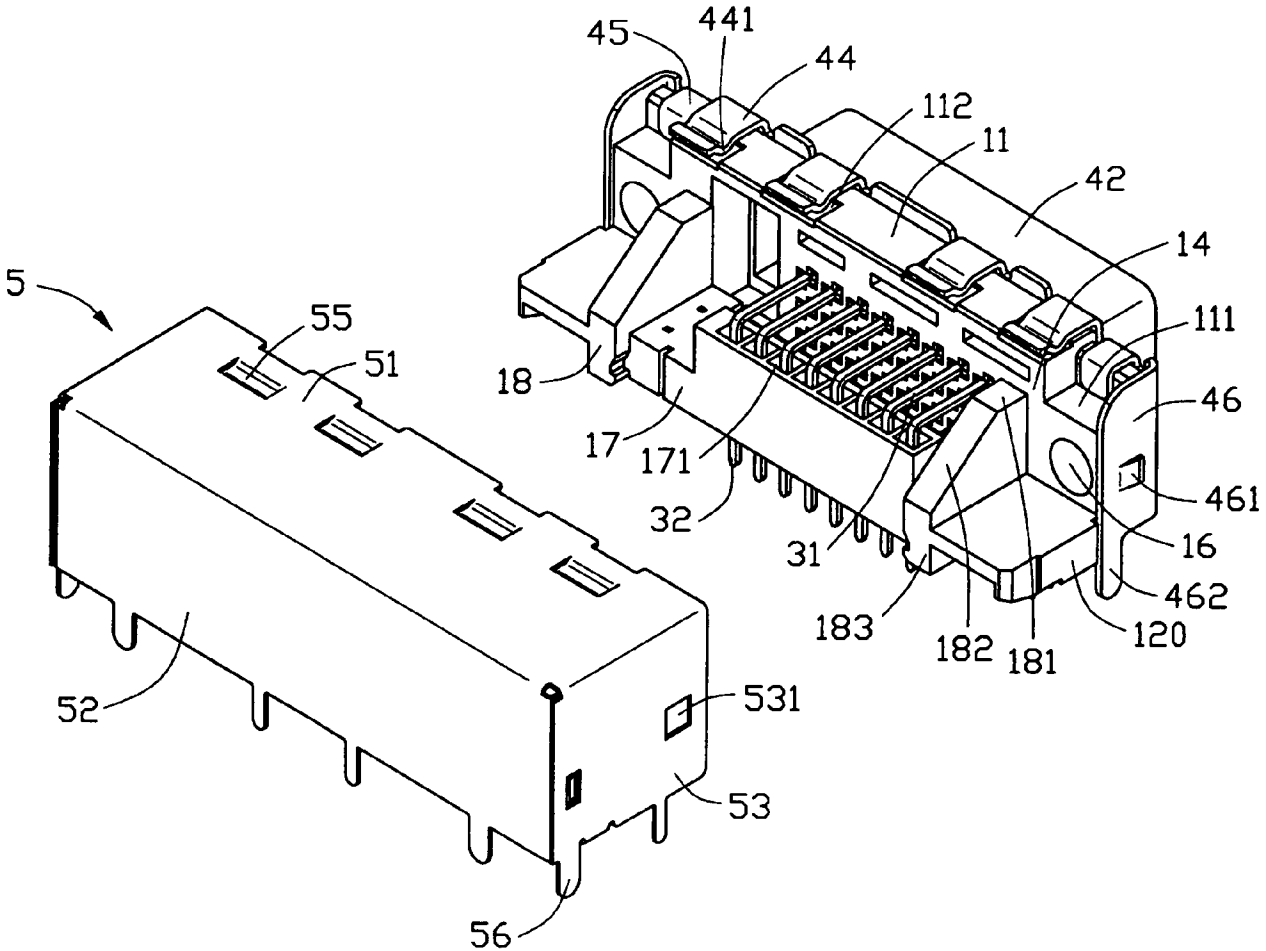
FIG. 2 is a partially assembled view of the connector shown in FIG. 1.

Referring to FIGS. 1 and 2, a DVI (Digital Visual Interface) connector 100 of the present invention for being mounted to a printed circuit board (PCB; not shown) comprises an insulative housing 1, a plurality of conductive contacts 3, a shielding device 40, and a pair of latch members 2.

Figure 3:
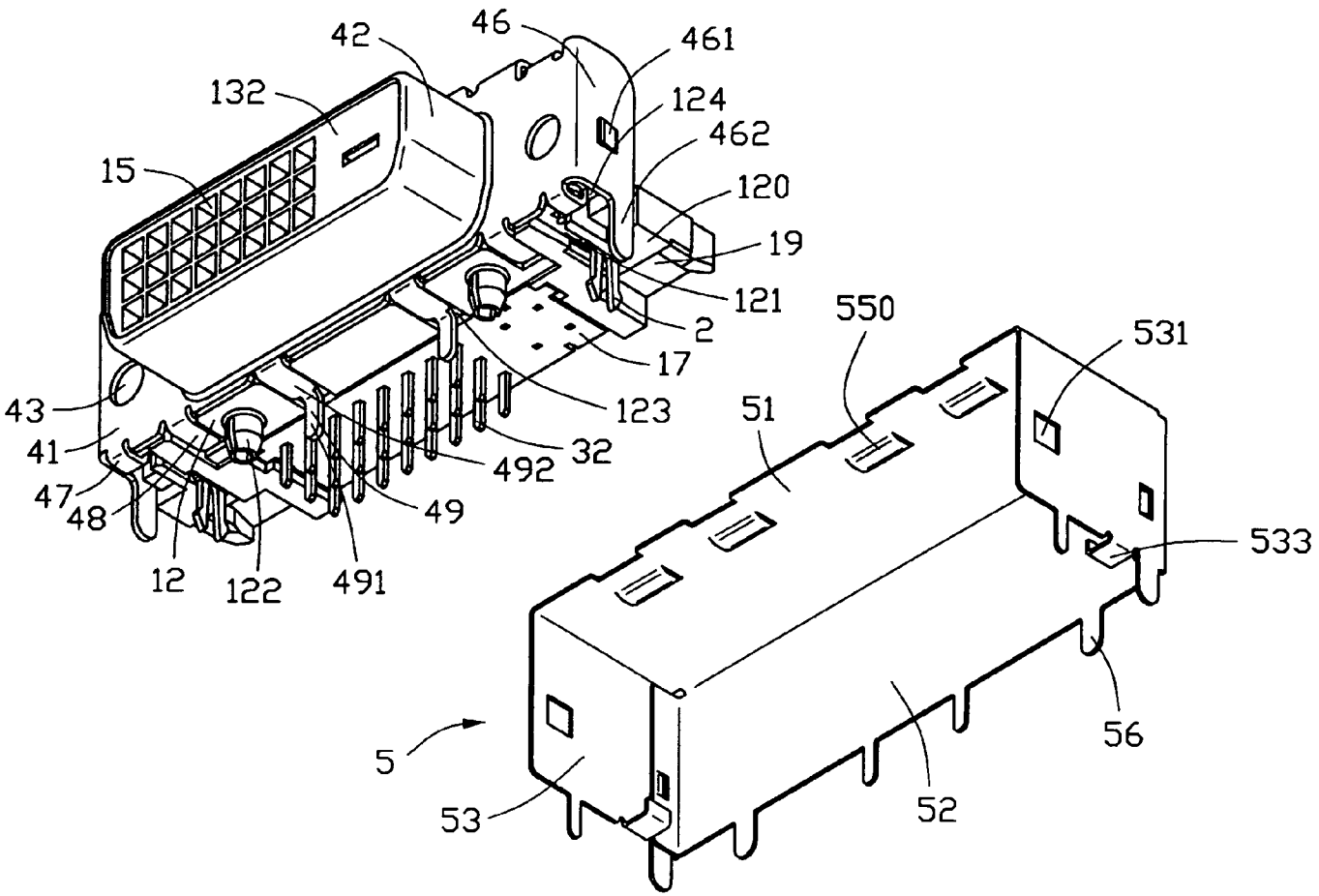
FIG. 3 is a view similar to FIG. 2 but taken from a different aspect.

Also referring to FIG. 3, the insulative housing 1 comprises an elongate base 10 having a top surface 11, a mounting surface 12 opposite to the top surface 11 and facing the PCB, a front surface 13 and a rear surface 14. A mating section 131 extends forwardly from the front surface 13 of the base portion 10. The mating section 131 has a D-shaped mating surface 132 at a front end thereof. The base 10 defines a pair of mounting holes 16 extending therethrough and located adjacent two ends thereof. The top surface 11 defines a pair of recesses 111 adjacent two ends thereof and a plurality of depressions 112 between the recesses 111. The insulative housing 1 defines a plurality of receiving passageways 15 for receiving the contacts 3 therein. The receiving passageways 15 extend through the mating section 131 and the base 10. A pair of parallel partitions 18 extend rearwardly from the rear surface 14 of the base 10. A dielectric holder 17 is positioned between and securely engages with the partitions 18. The dielectric holder 17 defines a plurality of positioning holes 171 extending therethrough. A pair of retention posts 122 extends downwardly from the mounting surface 12 and a plurality of indentations 123 is formed in the mounting surface 12. A pair of mounting sections 120 extend rearwardly from and adjacent opposite ends of the base 10. Each mounting section 120 defines a slit 121, a gap 124 communicating with the slit 121, and a locking cavity 19.

The contacts 3 are received in corresponding receiving passageways 15 of the insulative housing 1. Each contact 3 includes an engaging portion (not shown), a tail portion 32, and a connecting portion 31 connecting the engaging portion and the tail portion 32. The engaging portions are received in the receiving space 15 of the mating section 131 for mating with a complementary connector (not shown). The tail portions 32 are bent downwardly from a rear end of the connecting portions 31 and extend through the positioning holes 171 of the dielectric holder 17 for being connected to the PCB.

The shielding device 40 is made from a metal sheet and comprises a first and a second shielding portions 4, 5. The first shielding portion 4 is assembled to the base 10 and the mating section 131 of the insulative housing 1. The first shielding portion 4 comprises a body 41, a frame portion 42 extending forwardly from the body 41, a plurality of elastic plates 44 extending rearwardly from an upper end of the base 10, a pair of retention plates 49 extending rearwardly and downwardly from a lower end of the base 10, and a pair of flanges 46 bent rearwardly from two sides of the body 41. The frame portion 42 encloses the mating section 131 with the mating surface 132 exposed outside of the frame portion 42. The elastic plates 44 are positioned in the depression 112 on the top surface 11 of the housing 1. Each elastic plate 44 has an abutting portion 441 protruding downwardly. The flanges 46 enclose the two sides of the base 10 and each comprise a projection 461 at a middle portion thereof and a soldering end 462 at a lower portion thereof. A pair of retention holes 43 corresponding to the holes 16 are defined at the two sides of the body 41. A pair of first and second locking members 45, 47 are formed at the upper and the lower ends of the body 41 and adjacent to the flanges 46. The first locking members 45 lock with the recesses 111 of the base 10. The second locking members 47 lock with the gaps 124 of the mounting section 120. Thus, the first shielding portion 4 is securely assembled to the insulative housing 1. The body 41 further forms a pair of stopping plates 48 at the lower end thereof. Each stopping plate 48 is positioned between the second locking member 47 and the retention plate 49. Each retention plate 49 comprises a main portion 492 received in the indentation 123, and a finger 491 perpendicular to the main portion 492 for electrically connecting to the PCB for grounding purpose.

Figure 4:
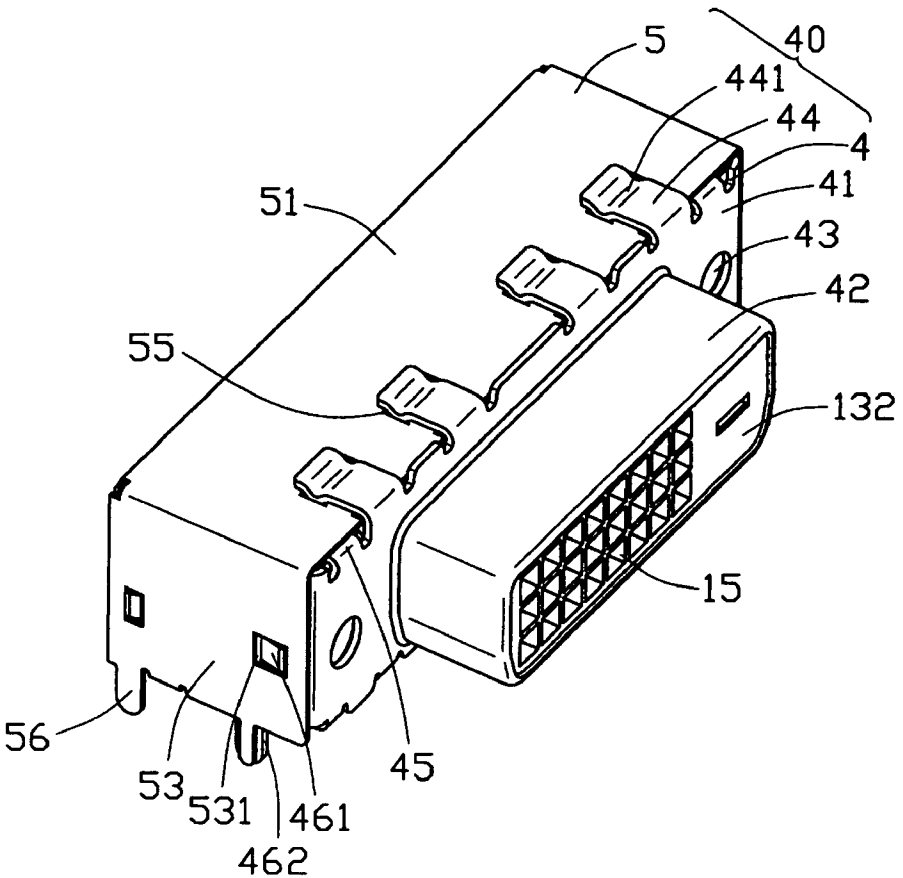
FIG. 4 is a fully assembled, perspective view of the connector of FIG. 1.

Referring to FIGS. 2–4, the second shielding portion 5 is assembled to a rear portion of the insulative housing 1. The second shielding portion 5 comprises a top wall 51, a rear wall 52, and opposite side walls 53 connecting with the top and the rear walls 51, 52. The top, the rear, and the side walls 51, 52, 53 together define a receiving space (not labeled). A plurality of concaves 55 are stamped at a front end of the top wall 51 to form a corresponding number of protrusions 550. The protrusions 550 are received in the depressions 112 of the base 10. The abutting portions 441 of the elastic plates 44 of the first shielding portion 4 are received in the concaves 55 and abut against the top wall 51. A securing recess 531 is defined in the side wall 53 and securely receives with the projection 461 of the flange 46. The first and the second shielding portions 4, 5 are securely assembled by a first engagement of the elastic plates 44 with the concaves 55 and a second engagement of the securing recesses 531 with the projections 461. Therefore, the first and the second shielding portions 4, 5 can achieve a good electrical and mechanical connection therebetween. A pair of locking arms 533 are formed at lower ends of the side walls 53. The locking arms 533 are received in the locking cavities 19. So, the second shielding portion 5 can be secured with the insulative housing 1. A plurality of soldering legs 56 extend downwardly from bottom ends of the rear and the side walls 52, 53 for electrically connecting to the PCB.

The latch members 2 are assembled into the mounting sections 120 of the insulative housing 1. Each latch member 2 includes a retention portion 22, a pair of tail portions 21 extending downwardly from a rear end of the retention portion 22 for inserting into corresponding holes (not shown) on the PCB, and a grasp member 23 extending horizontally from a front end of the retention portion 22. The grasp member 23 is installed in the second locking member 47 and electrically connects with the first shielding portion 4.

According to the above mentioned, the elastic plates 44 are received in the concaves 55 and abut against the top wall 51. The first and the second shielding portions 4, 5 are assembled securely and together enclose the insulative housing 1 and the contacts 3 completely for preventing electromagnetic interference and achieving a good electrical performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising an elongate base having a top surface, a mounting surface opposite to the top surface, a front surface and a rear surface connecting with the top surface and the mounting surface, and a mating section extending forwardly from the front surface of the base and having a mating surface, the housing defining a plurality of receiving passageways therein;

a plurality of contacts received in the receiving passageways; and a shielding device, comprising:

a first shielding portion including a body abutting against the front face of the base, a frame extending forwardly from the body and surrounding the mating section, and a plurality of elastic plates extending rearwardly from the body, each elastic plate having an abutting portion;

a second shielding portion assembled to a rear portion of the insulative housing and having a top wall, a rear wall, and two side walls, the top wall defining a plurality of concaves mating with the abutting portions of the elastic plates;

wherein the base defines a plurality of depressions on the top surface, and the second shielding portion has a plurality of protrusions corresponding to the concaves and receiving in the depressions and said concave is located between the corresponding abutting portion of the first shielding portion and the corresponding depression of the housing.

2. The connector as claimed in claim 1, wherein the first shielding portion further comprises a pair of flanges extending rearwardly from two sides of the body, each flange forming a projection thereon.

3. The connector as claimed in claim 2, wherein the side walls of the second shielding portion each define a securing recess mating with a corresponding projection of the first shielding portion.

4. The connector as claimed in claim 1, wherein the first shielding portion forms a first and a second locking members on an upper and a lower ends of the body, and the base defines a recess in the top surface and a gap in a bottom surface thereof, the first and the second locking members being respectively received in the recess and the gap.

5. The connector as claimed in claim 1, wherein the insulative housing further comprises a pair of mounting sections, the mounting sections having a pair of locking cavities therein, and the side walls of the second shielding portion have a pair of locking arms received in the locking cavities.

6. The connector as claimed in claim 1, wherein the second shielding portion comprises a plurality of soldering legs extending downwardly from bottom ends of the rear and the side walls for electrically connect to a printed circuit board.

7. The connector as claimed in claim 1, further comprising a pair of latch members assembled into the mounting sections.

8. The connector as claimed in claim 7, wherein the latch members each comprise a retention portion, a pair of tail portions extending downwardly from a rear end of the retention portion, and a grasp member extending perpendicularly from a front end of the retention portion.

9. An electrical connector comprising:

an insulative housing comprising an elongate base having a top surface defining a plurality of recesses;

a plurality of contacts disposed in the housing; and a shielding device, comprising:

a first shielding portion assembled to a portion of the insulative housing and including a plurality of elastic plates, each elastic plate having an abutting portion;

a second shielding portion assembled to an opposite portion of the insulative housing and having a top wall defining a plurality of concaves embedded in the corresponding recesses and mating with the abutting portions of the elastic plates, respectively; and wherein said elastic plates are exposed above the top wall, and said concave is located between the corresponding abutting portion of the first shielding portion and the corresponding recess of the housing.

10. The electrical connector as claimed in claim 9, wherein said first shielding portion further defines a frame portion extending forwardly from a vertical body where the elastic plates rearwardly extend, said frame portion covering a mating section of the housing, and the body covering a front surface of the housing.

* * * * *